US010423178B1

(12) United States Patent
Chen

(10) Patent No.: US 10,423,178 B1
(45) Date of Patent: Sep. 24, 2019

(54) LDO REGULATOR USING NMOS TRANSISTOR

(71) Applicant: Yangtze Memory Technologies Co., Ltd., Wuhan, Hubei Province (CN)

(72) Inventor: Weirong Chen, Wuhan (CN)

(73) Assignee: Yangtze Memory Technologies Co., Ltd., Wuhan, Hubei Province (CN)

( * ) Notice: Subject to any disclaimer, the term of this patent is extended or adjusted under 35 U.S.C. 154(b) by 0 days.

(21) Appl. No.: 16/182,521

(22) Filed: Nov. 6, 2018

Related U.S. Application Data

(63) Continuation of application No. PCT/CN2018/110037, filed on Oct. 12, 2018.

(51) Int. Cl.
*G05F 1/575* (2006.01)
*G05F 1/46* (2006.01)
*G05F 1/44* (2006.01)

(52) U.S. Cl.
CPC ..... *G05F 1/575* (2013.01); *G05F 1/44* (2013.01); *G05F 1/46* (2013.01); *G05F 1/461* (2013.01)

(58) Field of Classification Search
CPC ... G05F 1/10; G05F 1/267; G05F 1/46; G05F 1/567; G05F 1/569; G05F 1/571; G05F 1/573; G05F 1/5735; G05F 1/461; G05F 1/462; G05F 1/463; G05F 1/465; G05F 1/466; G05F 1/467; G05F 1/56; G05F 1/562; G05F 1/563; G05F 1/565; G05F 1/575; G05F 1/577; G05F 1/585; G05F 1/59; G05F 1/595; G05F 1/607; G05F 1/61; G05F 1/613; G05F 1/614; G05F 1/618
See application file for complete search history.

(56) References Cited

U.S. PATENT DOCUMENTS

| | | | | |
|---|---|---|---|---|
| 6,411,531 | B1 | 6/2002 | Nork | |
| 8,248,150 | B2 | 8/2012 | Tadeparthy | |
| 9,778,672 | B1 | 10/2017 | Gao | |
| 2012/0187935 | A1 | 7/2012 | Simons | |
| 2016/0334818 | A1 | 11/2016 | Singh | |
| 2017/0285675 | A1* | 10/2017 | Gao | G05F 1/575 |

FOREIGN PATENT DOCUMENTS

| | | | |
|---|---|---|---|
| CN | 101615046 | A | 12/2009 |
| CN | 102043417 | A | 5/2011 |
| CN | 102298407 | A | 12/2011 |
| CN | 103455076 | A | 12/2013 |

(Continued)

*Primary Examiner* — Yusef A Ahmed
*Assistant Examiner* — Bryan R Perez
(74) *Attorney, Agent, or Firm* — Winston Hsu

(57) ABSTRACT

A low dropout (LDO) regulator includes an NMOS transistor, a resistor ladder, an error amplifier and a gate boosting circuit. The NMOS transistor is configured for receiving an input voltage to generate an output voltage. The resistor ladder, coupled to the NMOS transistor, is configured for generating a feedback signal according to a level of the output voltage. The error amplifier, coupled to the resistor ladder, is configured for receiving the feedback signal from the resistor ladder to generate a control signal. The gate boosting circuit, coupled between the NMOS transistor and the error amplifier, is configured for boosting the control signal to control the NMOS transistor, so as to pull the output voltage to a target level.

7 Claims, 4 Drawing Sheets

(56) References Cited

FOREIGN PATENT DOCUMENTS

| | | | |
|---|---|---|---|
| CN | 103729007 | A | 4/2014 |
| CN | 103760943 | A | 4/2014 |
| CN | 105183067 | A | 12/2015 |
| CN | 106295073 | A | 1/2017 |
| CN | 106685193 | A | 5/2017 |
| EP | 3 107 209 | B1 | 8/2018 |
| TW | I431452 | B | 3/2014 |
| WO | 2018/057266 | A1 | 3/2018 |

* cited by examiner

LDO REGULATOR USING NMOS TRANSISTOR

CROSS REFERENCE TO RELATED APPLICATIONS

The present application is a continuation application of International Application No. PCT/CN2018/110037, filed on Oct. 12, 2018. The present application is based on and claims priority to International Application No. PCT/CN2018/110037, filed on Oct. 12, 2018, the contents of which are incorporated herein by reference in its entirety.

BACKGROUND OF THE INVENTION

1. Field of the Invention

The present invention relates to a low dropout (LDO) regulator, and more particularly, to an LDO regulator using an NMOS transistor as its output transistor.

2. Description of the Prior Art

A low dropout (LDO) regulator is widely used in various types of circuit systems due to its advantages of smaller device size, greater design simplicity, less current consumption and better power noise immunity. The LDO may convert an external power supply voltage to a regulated and stable internal power supply voltage. Conventionally, the LDO usually uses a PMOS transistor in its output stage. Please refer to FIG. 1, which is a schematic diagram of a conventional LDO regulator 10. In the LDO regulator 10, a PMOS transistor 102 converts an external input power supply voltage VCC to generate an output power supply voltage VDD for internal use. The LDO regulator 10 further includes a resistor ladder 104, an error amplifier 106 and a compensation capacitor C COMP. The resistor ladder 104 and the error amplifier 106 form the feedback loop. The compensation capacitor C COMP with large capacitance is disposed for compensation of frequency response, so as to enhance the stability and reduce output ripples.

However, the PMOS LDO regulator 10 suffers from several drawbacks. In detail, the transient response of the LDO regulator 10 depends on the reaction speed of the feedback loop, such that a rapid variation on the output power supply voltage VDD is regulated after the response time of the feedback loop; hence, the compensation capacitor C COMP is required to reduce output ripples before the feedback loop responds. In addition, the PMOS transistor 102 has less current capability in comparison with an NMOS transistor with the same size. Also, in the PMOS LDO regulator 10, the compensation capacitor C COMP is necessary and occupies a large area no matter whether it is disposed externally or internally. In modern integrated circuits, the circuit density becomes increasing and there is less room for filling the on-die compensation capacitor. Further, the system is requested to provide a higher flexibility on the range of input power supply voltage VCC while keeping the output power supply voltage VDD at the same level. For example, the output power supply voltage VDD is equal to 2.2V, while the system is required to operate normally when the input power supply voltage VCC is lowered to 2.35V. All above factors make a big challenge to the conventional PMOS LDO regulator.

SUMMARY OF THE INVENTION

It is therefore an objective of the present invention to provide a novel structure of low dropout (LDO) regulator using an NMOS transistor in its output stage, in order to solve the abovementioned problems.

An embodiment of the present invention discloses an LDO regulator, which comprises an NMOS transistor, a resistor ladder, an error amplifier and a gate boosting circuit. The NMOS transistor is configured for receiving an input voltage to generate an output voltage. The resistor ladder, coupled to the NMOS transistor, is configured for generating a feedback signal according to a level of the output voltage. The error amplifier, coupled to the resistor ladder, is configured for receiving the feedback signal from the resistor ladder to generate a control signal. The gate boosting circuit, coupled between the NMOS transistor and the error amplifier, is configured for boosting the control signal to control the NMOS transistor, so as to pull the output voltage to a target level.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
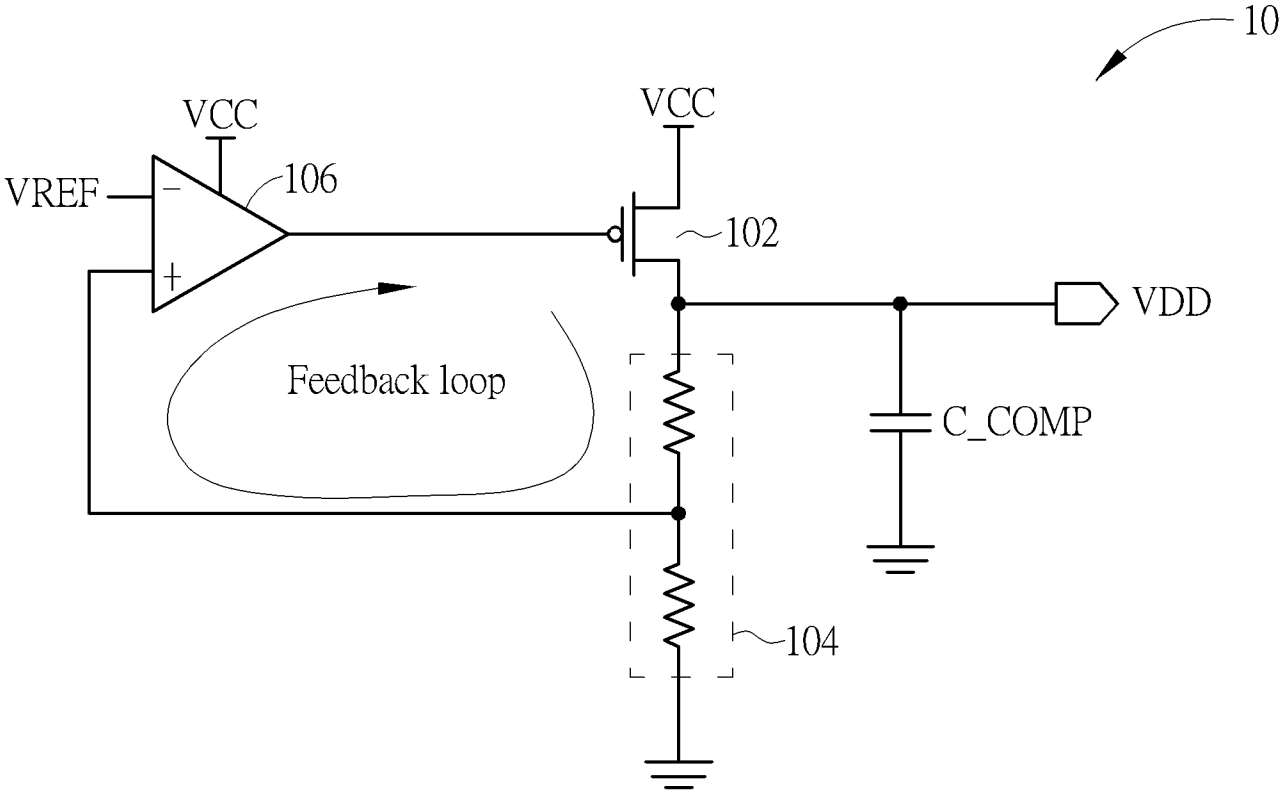
FIG. 1 PRIOR ART
FIG. 1 is a schematic diagram of a conventional LDO regulator.
Figure 2:
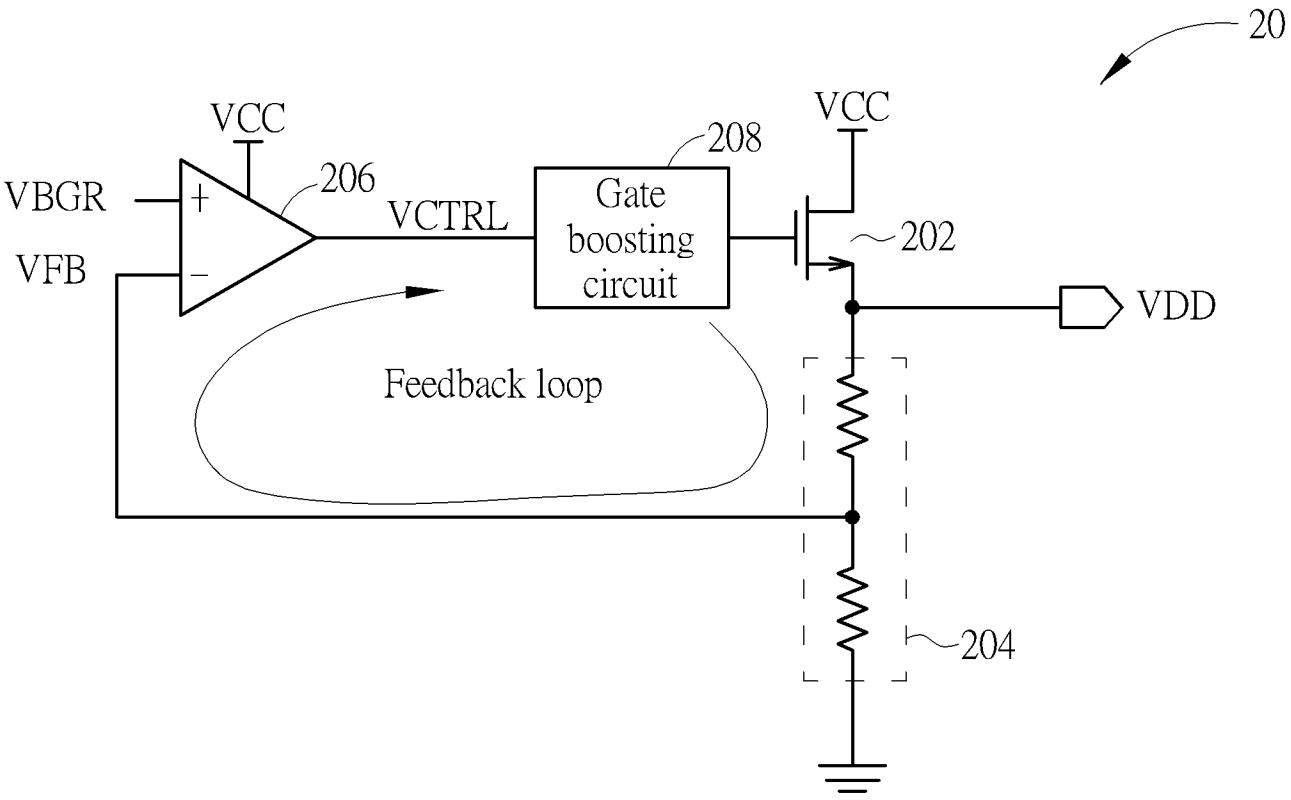
FIG. 2 is a schematic diagram of an LDO regulator according to an embodiment of the present invention.

Please refer to FIG. 2, which is a schematic diagram of a low dropout (LDO) regulator 20 according to an embodiment of the present invention. As shown in FIG. 2, the LDO regulator 20 includes an NMOS transistor 202, a resistor ladder 204, an error amplifier 206 and a gate boosting circuit 208. The NMOS transistor 202 is configured to receive an input power supply voltage VCC from a voltage source, to generate and output an output power supply voltage VDD. The resistor ladder 204, coupled to the NMOS transistor 202, is configured to generate a feedback signal VFB according to the level of the output power supply voltage VDD. The error amplifier 206, coupled to the resistor ladder 204, is configured to receive the feedback signal VFB from the resistor ladder 204 to generate a control signal VCTRL. In detail, the negative input terminal of the error amplifier 206 receives the feedback signal VFB, and the positive input terminal of the error amplifier 206 receives a bandgap reference voltage VBGR or any voltage generated from a bandgap circuit. Therefore, the error amplifier 206 outputs the control signal VCTRL according to the difference between the feedback signal VFB and the bandgap reference voltage VBGR. The gate boosting circuit 208, coupled between the NMOS transistor 202 and the error amplifier 206, is configured to boost the control signal VCTRL to control the gate terminal of the NMOS transistor 202, so as to pull the output power supply voltage VDD to a target level.

In the LDO regulator 20, the NMOS transistor 202, which receives the input power supply voltage VCC via its drain terminal, receives the boosted control signal from the gate boosting circuit 208 via its gate terminal, and outputs the output power supply voltage VDD via its source terminal, is served as a source follower. Therefore, when the output power supply voltage VDD changes due to a transient load variation, the NMOS transistor 202 may immediately increase or decrease its output current prior to the response time of the feedback loop.

In detail, the operation of the NMOS transistor 202 follows the MOSFET equation shown below:

$$\Delta I = K\frac{W}{L}(Vg - \Delta VDD - Vth)^2;$$

wherein ΔI is the variation of the drain current of the NMOS transistor 202, K is the transconductance factor of the NMOS transistor 202, W/L is the ratio of width to length, Vg and Vth are the gate voltage and the threshold voltage of the NMOS transistor 202, and ΔVDD is the variation of the output power supply voltage VDD. When the output power supply voltage VDD tends to drop rapidly, the current flowing through the NMOS transistor 202 increases immediately to pull the output power supply voltage VDD up before the feedback loop responds. When the output power supply voltage VDD tends to rise rapidly, the current flowing through the NMOS transistor 202 decreases immediately to pull the output power supply voltage VDD down before the feedback loop responds. Therefore, the source follower formed by the NMOS transistor 202 responds immediately when the output power supply voltage VDD tends to change due to transient load variations. This significantly reduces or eliminates the ripples on the output power supply voltage VDD. As for the small signal analysis, the source follower formed by the NMOS transistor 202 provides a low output resistance, which pushes the output pole to a higher frequency; hence, the compensation scheme may become much easier.

In such a situation, the source follow is able to respond and reduce the output ripples before the feedback loop responds; hence, the compensation capacitor for the output power supply voltage VDD may be omitted, or only a compensation capacitor with small size and less capacitance is required. Afterwards, the feedback loop takes place to manipulate the gate terminal of the NMOS transistor 202 to a certain level, to control the output power supply voltage VDD to reach its target level.

Please note that when the input power supply voltage VCC is close to the output power supply voltage VDD, the gate voltage of the NMOS transistor 202 may not reach a higher enough level to pull up the output power supply voltage VDD. In an exemplary embodiment, the input power supply voltage VCC is equal to 2.35V and the output power supply voltage VDD is equal to 2.2V. Therefore, the gate boosting circuit 208 is implemented to boost the control signal VCTRL for controlling the NMOS transistor 202. Preferably, the NMOS transistor 202 is a zero volt threshold-voltage (ZVT) NMOS transistor, which is turned on to pull up the output power supply voltage VDD more easily with the boosted control signal VTRL.

Figure 3:
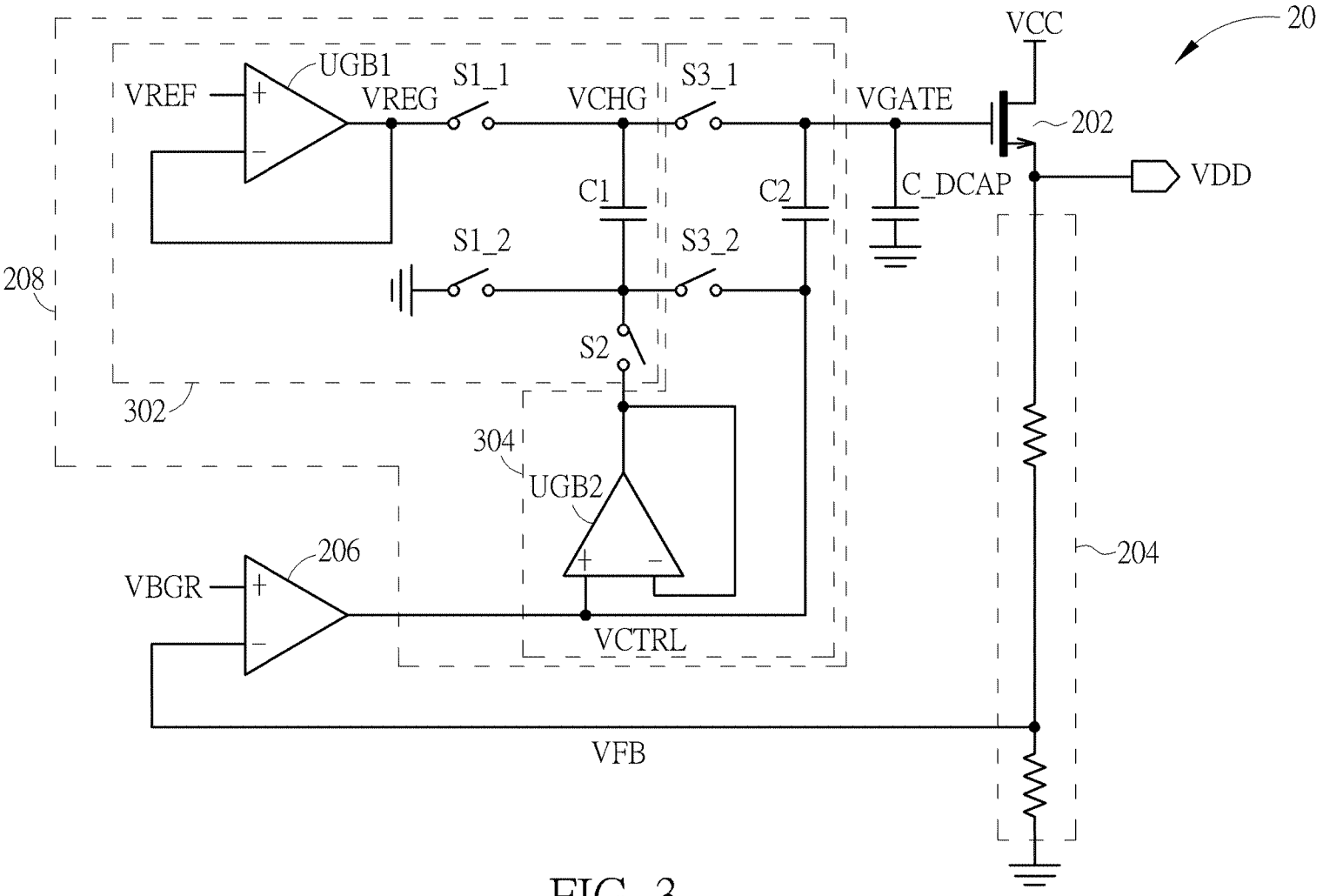
FIG. 3 is a schematic diagram of the LDO regulator with a detailed implementation of the gate boosting circuit.

Please refer to FIG. 3, which is a schematic diagram of the LDO regulator 20 with a detailed implementation of the gate boosting circuit 208. As shown in FIG. 3, the gate boosting circuit 208 includes a pumping circuit 302 and an isolating circuit 304. The pumping circuit 302 is configured to boost the control signal VCTRL. The isolating circuit 304 is configured to isolate the output terminal of the error amplifier 206 (where the control signal VCTRL is generated) from parasitic capacitance. The pumping circuit 302 includes a unity gain buffer UGB1, a capacitor unit C1, and switches S1_1, S1_2 and S2. The isolating circuit 304 includes a unity gain buffer UGB2, a capacitor unit C2, and switches S3_1 and S3_2. Note that although each of the capacitor units C1 and C2 is illustrated as a single capacitor in FIG. 3, those skilled in the art should understand that one capacitor unit may be a single capacitor or a combination of multiple capacitors or equivalent capacitance coupled together. In detail, the switch S1_1 is coupled between the unity gain buffer UGB1 and a first terminal of the capacitor unit C1. The switch S1_2 is coupled between a second terminal of the capacitor unit C1 and the ground terminal. The switch S2 is coupled between the unity gain buffer UGB2 and the second terminal of the capacitor unit C1. The switch S3_1 is coupled between the first terminal of the capacitor unit C1 and a first terminal of the capacitor unit C2. The switch S3_2 is coupled between the second terminal of the capacitor unit C1 and a second terminal of the capacitor unit C2. The positive input terminal of the unity gain buffer UGB2 and the second terminal of the capacitor unit C2 are further coupled to the output terminal of the error amplifier 206. The negative input terminal of the unity gain buffer UGB2 is coupled to its output terminal. Further, the positive input terminal of the unity gain buffer UGB1 receives a reference voltage VREF, and the negative input terminal of the unity gain buffer UGB1 is coupled to its output terminal.

The structure of the gate boosting circuit 208 shown in FIG. 3 may shift up the control signal VCTRL from the error amplifier 206, to generate a gate control signal VGATE by using the switching capacitor boosting scheme. The gate boosting circuit 208 then outputs the gate control signal VGATE to the gate terminal of the NMOS transistor 202. With controls of switching clocks, the switches S1_1, S1_2, S2, S3_1 and S3_2 cooperate to boost the control signal VCTRL with a regulation voltage VREG, so as to generate the gate control signal VGATE.

In detail, in the first phase, the switches S1_1 and S1_2 are turned on, and the switches S2, S3_1 and S3_2 are turned off. Therefore, the bottom plate (i.e., the second terminal) of the capacitor unit C1 is grounded and the top plate (i.e., the first terminal) of the capacitor unit C1 is charged to the regulation voltage VREG, which is generated from the reference voltage VREF via the unity gain buffer UGB1. In the second phase, the switch S2 is turned on, and the switches S1_1, S1_2, S3_1 and S3_2 are turned off. Therefore, the bottom plate of the capacitor unit C1 is charged to the voltage of the control signal VCTRL via the unity gain buffer UGB2; hence, the top plate of the capacitor unit C1 is shifted to a voltage VCHG given by:

$$VCHG = VCTRL + VREG.$$

In the third phase, the switches S3_1 and S3_2 are turned on, and the switches S1_1, S1_2 and S2 are turned off. Therefore, the bottom plates of the capacitor units C1 and C2 are coupled to the error amplifier 206 for receiving the control signal VCTRL. The top plates of the capacitor units C1 and C2 are connected to each other to perform charge sharing. After several cycles of switching between the first phase, the second phase and the third phase, the voltage across the capacitor unit C2 is equal to VREG; hence, the voltage of the gate control signal VGATE may be derived by:

$$VGATE = VCTRL + VREG.$$

As a result, the error amplifier 206 always senses the output power supply voltage VDD by receiving the feedback signal VFB, and generates the control signal VCTRL accordingly. The control signal VCTRL is then boosted to generate the gate control signal VGATE to control the drain current of the NMOS transistor 202, which in turn pulls the output power supply voltage VDD to its target level. Therefore, the error amplifier 206 may regulate and stabilize the output power supply voltage VDD by manipulating the control signal VCTRL and the gate control signal VGATE.

Please note that the switching operations of the gate boosting circuit 208 may generate ripples on the gate control signal VGATE, and thus generate ripples on the output power supply voltage VDD. In order to solve this problem, the unity gain buffer UGB2 is implemented to lower the ripples on the output power supply voltage VDD. More specifically, the capacitor units C1 and C2 are served to boost voltage signals, and these capacitors may be disposed inside the chip, e.g., formed by MOS devices. Therefore, these capacitor units C1 and C2 are accompanied by parasitic capacitance. When the gate boosting circuit 208 is switched from the first phase to the second phase, the parasitic capacitance on the bottom plate of the capacitor unit C1 is charged up from 0 to VCTRL. Due to this parasitic capacitance, a sudden ripple may be generated on the control signal VCTRL if the unity gain buffer UGB2 is absence. The sudden ripple may be coupled to the gate control signal VGATE and also coupled to the output power supply voltage VDD. Therefore, the unity gain buffer UGB2 isolates the parasitic capacitance of the capacitor unit C1 from the output terminal of the error amplifier 206, so as to reduce or prevent this switching ripple.

Preferably, the error amplifier 206 has a rail-to-rail output where the control signal VCTRL ranges between the ground voltage and the input power supply voltage VCC. The voltage VCHG and the gate control signal VGATE may be boosted to a higher level under the upper limit of the safe operating area of the circuit elements in the gate boosting circuit 208. In addition, the lower limit of the gate control signal VGATE may be a voltage level while the error amplifier 206 outputs 0V as the control signal VCTRL. At this moment, the voltage of the gate control signal VGATE is equal to the regulation voltage VREG and also equal to the reference voltage VREF. The lower limit of the gate control signal VGATE should be lower enough to cut off the NMOS transistor 202, and may be well controlled by configuring the level of the reference voltage VREF.

It should also be noted that the circuit structure of the LDO regulator 20 has high impedance at the gate terminal of the NMOS transistor 202. Therefore, the gate terminal of the NMOS transistor 202 suffers from voltage coupling, especially from the output power supply voltage VDD through the parasitic gate-to-source capacitor Cgs of the NMOS transistor 202. In order to prevent or reduce this problem, a decoupling capacitor C_DCAP is disposed and coupled to the gate terminal of the NMOS transistor 202, as shown in FIG. 3. The decoupling capacitor C_DCAP may reduce the ripples coupled from the output terminal of the LDO regulator 20 due to load variations or noise interference. However, the deployment of the decoupling capacitor C_DCAP is accompanied by weakened control capability of the error amplifier 206. In this case, the transfer function from the control signal VCTRL to the gate control signal VGATE is given by:

$$\Delta VGATE = \Delta VCTRL \times \left(\frac{C2}{C2 + \text{C_DCAP} + Cg}\right);$$

wherein ΔVGATE and ΔVCTRL respectively refer to the variations of the gate control signal VGATE and the control signal VCTRL, and Cg is the parasitic capacitance at the gate terminal of the NMOS transistor 202.

Please note that the present invention aims at providing an LDO regulator using an NMOS transistor as its output transistor which is controlled by a boosted control signal via a feedback loop having a gate boosting circuit. Those skilled in the art may make modifications and alternations accordingly. For example, the LDO regulator of the present invention is capable of receiving a wide range of input voltage to generate a feasible output voltage, where the voltage values are not limited to the examples described in the present disclosure. In addition, the gate boosting circuit 208 aims at boosting the control signal VCTRL received from the error amplifier 206 to generate the gate control signal VGATE, and the boosting scheme and the related circuit structure may be implemented in other manner, which should not be limited herein. For example, in the LDO regulator 20, the gate control signal VGATE requires several switching cycles to be settled to its target level when power up or when the LDO regulator 20 is activated, and the settling speed is determined by the ratio of the capacitor units C2 and C1 and the clock frequency controlling the switches. In another embodiment, a precharge circuit may be disposed to significantly increase the settling speed of the gate control signal VGATE and the LDO regulator 20.

Figure 4:
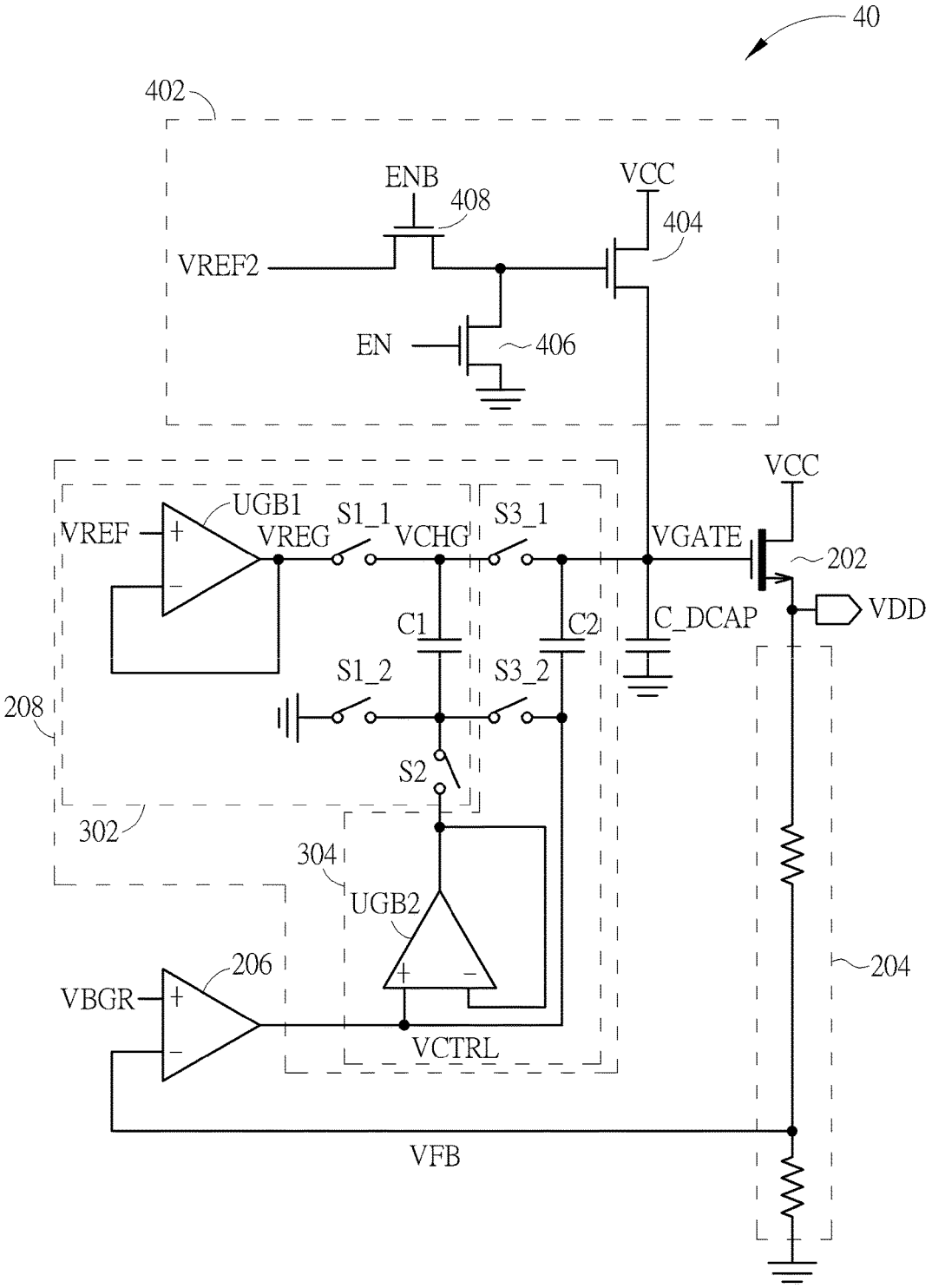
FIG. 4 is a schematic diagram of another LDO regulator according to an embodiment of the present invention.

Please refer to FIG. 4, which is a schematic diagram of another LDO regulator 40 according to an embodiment of the present invention. As shown in FIG. 4, the structure of the LDO regulator 40 is similar to the structure of the LDO regulator 20 shown in FIG. 3; hence, the circuit elements and modules with similar functions are denoted by the same symbols. The difference between the LDO regulator 40 and the LDO regulator 20 is that, the LDO regulator 40 further includes a precharge circuit 402, which is composed of a charging transistor 404 and two control transistors 406 and 408. In detail, the precharge circuit 402 is coupled to the gate terminal of the NMOS transistor 202, for settling the gate control signal VGATE to its target voltage level with a higher settling speed when the LDO regulator 40 is activated or enabled. The control transistors 406 and 408 form a control path, for receiving a reference voltage VREF2 when the control path is turned on. The charging transistor 404 thereby precharges the gate control signal VGATE to its target voltage level based on the reference voltage VREF2.

In this embodiment, the control transistors 406 and 408 are controlled by enable signals EN and ENB, respectively. The enable signal EN indicates whether the LDO regulator 40 has been enabled or activated, and the enable signal ENB is a signal inverse to the enable signal EN. In detail, before the LDO regulator 40 is activated, the control transistor 406 is turned off by the enable signal EN and the control transistor 408 is turned on by the enable signal ENB. In such a situation, the control path is turned on, and the charging transistor 404 may start to charge the gate terminal of the NMOS transistor 202 when both the input power supply voltage VCC and the reference voltage VREF2 are ready. Therefore, the voltage level of the gate control signal VGATE may rise to its target level rapidly without waiting for switching operations of the gate boosting circuit 208. This significantly increases the settling speed of the gate control signal VGATE. Preferably, the charging transistor 404 may be a ZVT NMOS transistor, which allows the gate control signal VGATE to be pulled up to a level substantially equal to the reference voltage VREF2 during the precharging process. As a result, the target voltage level of the gate control signal VGATE may be well controlled by configuring the reference voltage VREF2. The reference voltage VREF2 may be configured to be equal to the reference voltage VREF provided for the gate boosting circuit 208, or equal to any other appropriate voltage level.

To sum up, the present invention provides an LDO regulator using an NMOS transistor as its output transistor. A gate boosting circuit using a switching capacitor boosting scheme is included in the LDO regulator, to increase the voltage level of the gate control signal for controlling the NMOS output transistor, so as to be adapted to the situation where the input voltage of the LDO regulator is close to the output voltage of the LDO regulator. The NMOS transistor is preferably a ZVT transistor, which may be turned on to regulate the output voltage more easily with the boosted control signal. In addition, a decoupling capacitor may be disposed at the gate terminal of the NMOS transistor, to reduce the ripples coupled from the output terminal of the LDO regulator due to load variations or noise interference. A precharge circuit may also be included to increase the settling speed of the gate control signal for the NMOS transistor. The implementation of the LDO regulator with NMOS output transistor may reduce the output ripples without the usage of large compensation capacitors, which reduces the size of the LDO regulator and also improves the regulation performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A low dropout (LDO) regulator, comprising:

an NMOS transistor, for receiving an input voltage to generate an output voltage;

a resistor ladder, coupled to the NMOS transistor, for generating a feedback signal according to a level of the output voltage;

an error amplifier, coupled to the resistor ladder, for receiving the feedback signal from the resistor ladder to generate a control signal; and a gate boosting circuit, coupled between the NMOS transistor and the error amplifier, for boosting the control signal to control the NMOS transistor, so as to pull the output voltage to a target level;

wherein the gate boosting circuit comprises:

a pumping circuit, for boosting the control signal with a regulation signal to control the NMOS transistor, the pumping circuit comprising:

a first unity gain buffer;

a first capacitor unit;

a first switch, coupled between the first unity gain buffer and a first terminal of the first capacitor unit;

a second switch, coupled between a second terminal of the first capacitor unit and a ground terminal; and a third switch, coupled between a second unity gain buffer and the second terminal of the first capacitor unit; and an isolating circuit, coupled to the pumping circuit, for isolating a parasitic capacitance from an output terminal of the error amplifier, the isolating circuit comprising:

the second unity gain buffer;

a second capacitor unit;

a fourth switch, coupled between the first terminal of the first capacitor unit and a first terminal of the second capacitor unit; and a fifth switch, coupled between the second terminal of the first capacitor unit and a second terminal of the second capacitor unit.

2. The LDO regulator of claim 1, wherein the NMOS transistor is a zero volt threshold-voltage transistor.

3. The LDO regulator of claim 1, wherein the NMOS transistor comprises:

a first terminal, for receiving the input voltage from a voltage source;

a second terminal, for outputting the output voltage; and a control terminal, for receiving the boosted control signal from the gate boosting circuit.

4. The LDO regulator of claim 1, wherein the first unity gain buffer is configured to generate the regulation signal, and all of the switches are configured to boost the control signal with the regulation signal to control the NMOS transistor.

5. The LDO regulator of claim 1, further comprising:

a decoupling capacitor, coupled to a control terminal of the NMOS transistor.

6. The LDO regulator of claim 1, further comprising:

a precharge circuit, coupled to a control terminal of the NMOS transistor.

7. The LDO regulator of claim 6, wherein the precharge circuit comprises:

a control path, for receiving a reference voltage when the control path is turned on; and a charging transistor, coupled to the control circuit, for precharging the control terminal of the NMOS transistor to a voltage level substantially equal to the reference voltage.

* * * * *